United States Patent [19]

Krehbiel et al.

[11] 4,110,774

[45] Aug. 29, 1978

[54] FILM GUIDE FOR FILM PROCESSING EQUIPMENT

[75] Inventors: Vivian D. Krehbiel; Ralph L. Haas, both of Wichita, Kans.

[73] Assignee: Kreonite, Inc., Wichita, Kans.

[21] Appl. No.: 739,434

[22] Filed: Nov. 8, 1976

[51] Int. Cl.[2] ..... G03D 13/10

[52] U.S. Cl. ..... 354/345; 226/91; 352/235

[58] Field of Search ..... 354/319, 321, 345, 346, 354/313, 340; 352/235; 226/91, 92; 242/74, 74.1, 74.2

[56] References Cited

U.S. PATENT DOCUMENTS

| | | | |
|---|---|---|---|
| 1,655,297 | 1/1928 | Thornton | 352/235 X |
| 3,462,054 | 8/1969 | Foor | 226/91 |

FOREIGN PATENT DOCUMENTS

| | | | |
|---|---|---|---|
| 946,458 | 12/1948 | France | 352/235 |
| 1,004,040 | 3/1957 | Fed. Rep. of Germany | 352/235 |

*Primary Examiner*—John Gonzales
*Attorney, Agent, or Firm*—Edwin H. Crabtree

[57] ABSTRACT

An elongated flexible leader for inserting into a film processor and guiding a roll of undeveloped film therethrough. The leader is attached to the film by inserting a tongue which is part of the leader through an aperture in one end of the film.

2 Claims, 5 Drawing Figures

FILM GUIDE FOR FILM PROCESSING EQUIPMENT

BACKGROUND OF THE INVENTION

This invention relates generally to film processing equipment and more particularly, but not by way of limitation, to a film guide used in guiding undeveloped film through a film processor.

Heretofore, there have been various types of film strip leaders, supply leaders for magnetic tape and film, and guides used in leading flexible material through different types of processing equipment. Also in the processing of film, exposed film has been used as a film guide. The exposed film is attached to the film to be developed by metal clips, adhesives or tape.

None of the prior art guides provide a flexible leader which allows one end of a roll of film to be quickly attached thereto and also allows the film to pivot on one end of the leader as it is inserted into and guided through the film processing equipment.

SUMMARY OF THE INVENTION

The film guide is simple in design, and inexpensive in construction. The guide is durable and can be used continuously in guiding undeveloped film through chemical processing tanks. The guide is made of sheet plastic, mylar, or any other similar type of flexible material which does not react chemically to the liquids used in processing film.

The invention is attached to the film by a tongue which is quickly inserted into an aperture at one end of the film. This type of attachment eliminates the use of metal clips, adhesives and tape. Also, the film is allowed to pivot on the attached tongue should the film be placed on the guide at an angle or should the film need to pivot on the guide as it is fed through the film processing equipment.

The film guide includes an elongated flexible leader having a flat surface. A rear portion of the leader includes an elongated tongue parallel to the length of the leader and extending rearwardly therefrom. The tongue is attached to one end of a roll of film by inserting the tongue through an aperture in one end of the film.

The advantages and objects of the invention will become evident from the following detailed description when read in conjunction with the accompanying drawings which illustrate the preferred embodiments of the invention.

BRIEF DESCRIPTION OF THE DRAWINGS

FIG. 1-A is a side view of the film guide.

FIG. 2-A is a side view of the alternate embodiment of the film guide.

DETAILED DESCRIPTION OF THE DRAWINGS

Figure 1:
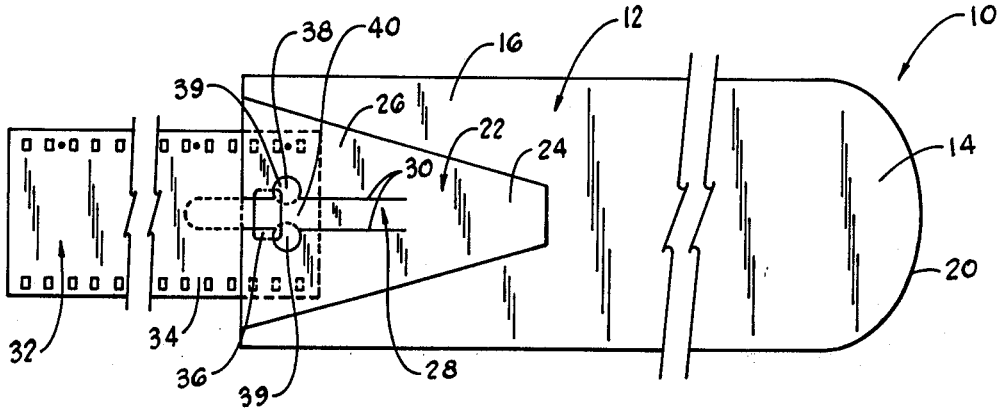
FIG. 1 is a top view of the film guide attached to one end of a film to be developed.
Figure 1A:
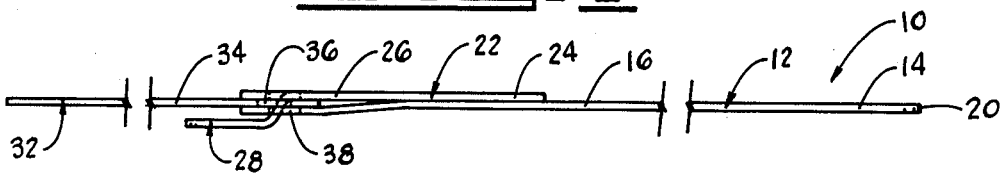

In FIG. 1, the film guide is designated by general reference numeral 10. The guide 10 includes an elongated flexible leader 12 having a front portion 14 and a rear portion 16. The front portion 14 includes a curved edge portion 20 for ease in inserting the guide 10 into the film processing equipment. The leader 12 may be made of a flat sheet material made of plastic, mylar, or the like.

Attached to the rear portion 16 of the leader 12 is an angular shaped flexible keeper 22. The keeper 22 includes a front portion 24 and a rear portion 26. The front portion 24 of the keeper 22 is attached to the top of the leader 12 by an adhesive or bonding agent. The rear portion of the keeper 22 includes a tongue 28 extending rearwardly from the keeper 22 and the rear portion 16 of the leader 12. The tongue 28 is formed by cutting a pair of parallel lines 30 in the center of the rear portion 26 of the keeper 22. The edge of the rear portion 26 of the keeper 22 and the edge of the rear portion 16 of the leader 12 are then trimmed back so that the end of the tongue 28 extends outwardly therefrom.

A roll of undeveloped film 32 having an end portion 34 is attached to the leader 12 by inserting the tongue 28 through an aperture 36 in the end portion 34 of the film 32. The tongue 28 is also inserted through an aperture 38 formed in part by a pair of punched holes 39 in the rear portion 16 of the leader 12. The aperture 38 is disposed adjacent the aperture 36 in the film 32. The tongue 28 further includes a neck portion 40 formed by the pair of punched holes 39 which take a portion of the sides of the tongue 28 as the holes 39 are punched therethrough. The neck portion 40 of the tongue 28 provides a surface wherein the film 32 can pivot thereon should the film 32 be placed on the leader 12 at an angle or should the film 32 be required to pivot on the leader 12 as it is guided through the film processor.

In FIG. 1-A, a side view of the film guide 10 is illustrated. In this view, the tongue 28 can be seen inserted through the aperture 36 in the end portion 34 of the film 32 and through the adjacent aperture 38 in the leader 12. The film 32 is now secured between the keeper 22 and the top of the rear portion 16 of the leader 12.

Figure 2:
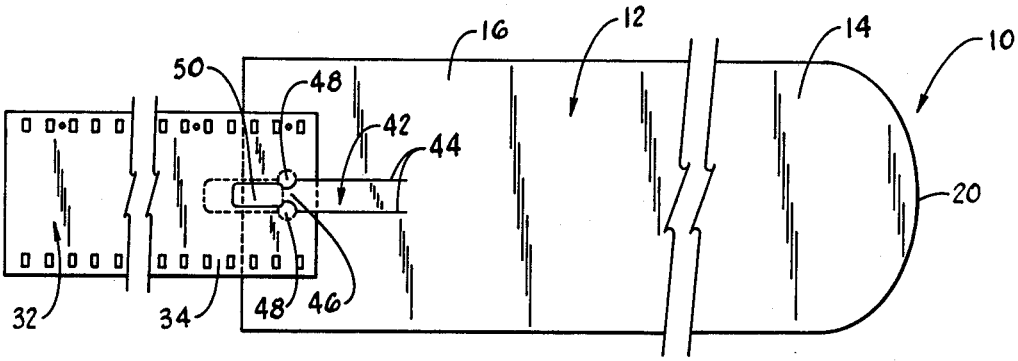
FIG. 2 is a top view of an alternate embodiment of the film guide.
Figure 2A:
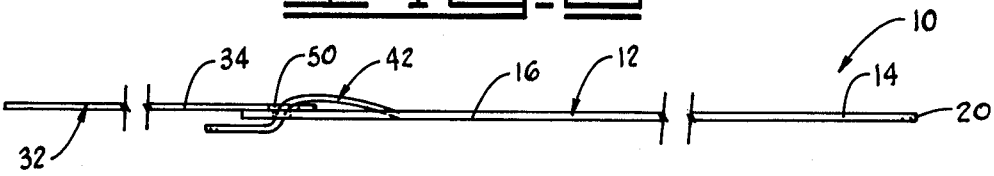

In FIG. 2, an alternate embodiment of the guide 10 is illustrated. In this illustration, the end portion 34 of the film 32 is attached to the leader 12 without the use of the keeper 22. A tongue 42 is formed in the rear portion 16 of the leader 12 by cutting a pair of parallel lines 44 through the center of the rear portion 16 and parallel to the length of the leader 12. The end of the tongue 42 extends outwardly from the rear of the leader 12 by cutting back a portion of the edge of the rear portion 16 of the leader 12. A neck portion 46 in the tongue 42 is formed by a pair of punched holes 48 through the leader 12 and taking a portion of the edge of the tongue 42.

In the end portion 34 of the film 32, an aperture 50 is formed through the film 32. The aperture 50 is characterized by having a width greater than the width of the neck portion 46 of the tongue 42. The width of the tongue 42, in turn, is greater than the width of the aperture 50 but less than the length of the aperture 50. This allows the end of the tongue 42 to be inserted perpendicularly to the length of the film 34 and into the aperture 50. The tongue 42 of the film 32 can then be pivoted so that the leader 12 is again parallel to the length of the film 32, thereby securing the film 32 to the leader 12.

In FIG. 2-A, a side view of the guide 10 is illustrated with the tongue 42 inserted through the aperture 50 of the film 32 thereby securing the film 32 to the leader 12.

Figure 3:
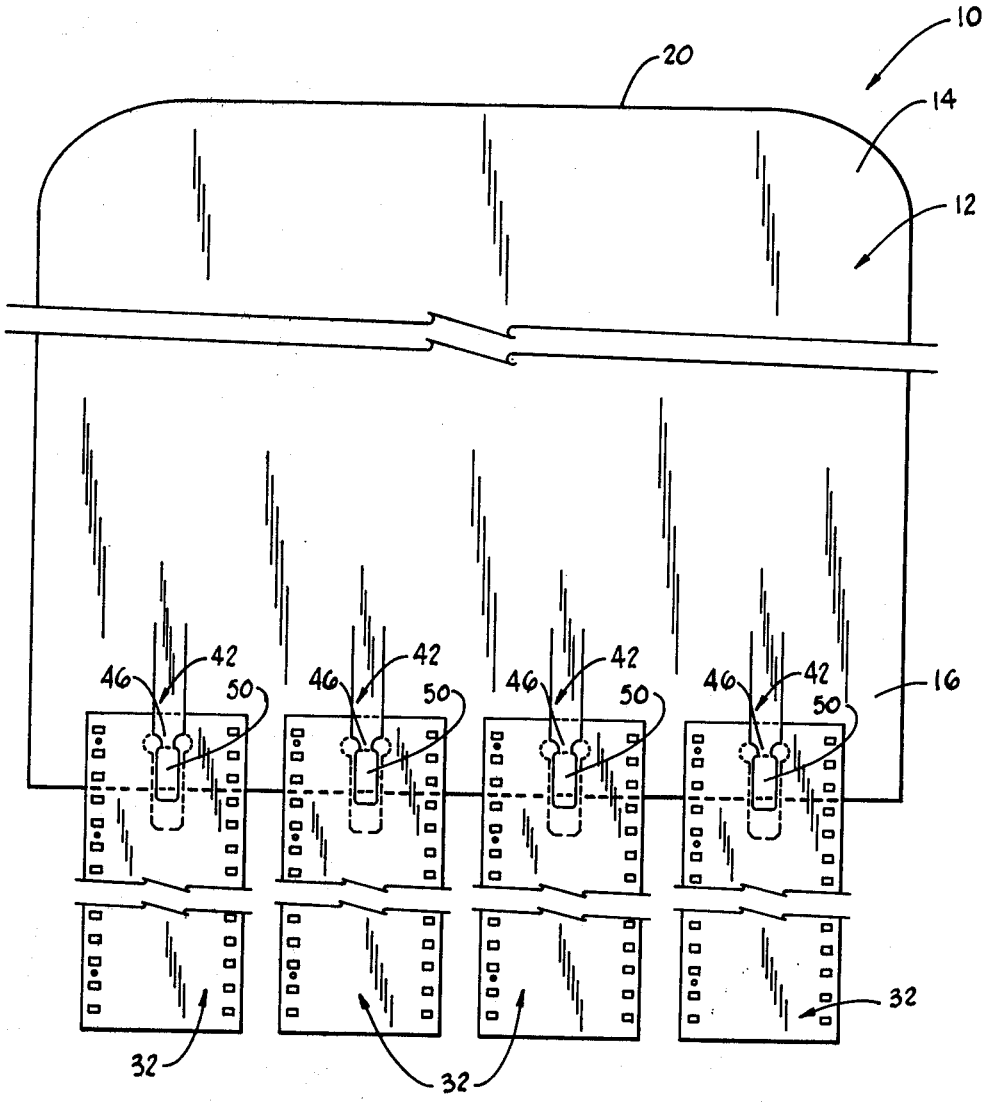
FIG. 3 is a top view of the film guide attached to a plurality of film rolls to be developed.

In FIG. 3, the guide 10 is illustrated wherein the elongated flexible leader 12 includes a plurality of tongues 42 similar to the tongue 42 illustrated in FIG. 2. The tongues 42 are cut in the rear portion 16 of the leader 12 and parallel to the length thereof. The rear edge of the leader 12 is then cut along the width so that the ends of the tongues 42 extend outwardly therefrom. The film 32 is then attached to the leader 12 by turning the film 32 perpendicular to the length of the leader 12 and inserting one of the tongues 32 into the length of the aperture 50 and then turning the film 32 about the neck portion 46 until the film is in a trailing relationship behind the leader 12.

Changes may be made in the construction and arrangement of the parts or elements of the embodiment as disclosed herein without departing from the spirit or scope of the invention as defined in the following claims.

I claim:

1. A film guide for film processing equipment, the guide comprising:

an elongated flexible leader having a flat surface, said leader having a front portion and a rear portion;

an aperture disposed in the rear portion of said leader and therethrough;

a flat flexible keeper having a front portion and a rear portion, the front portion of said keeper attached to the top of said leader; and an elongated tongue intergrally formed in the rear portion of said keeper by cutting a pair of parallel lines therethrough;

the end of a roll of film having an aperture therethrough is received between the rear portion of said keeper and the rear portion of said leader, the film held in place by threading said tongue through the aperture in the film and through the aperture in the rear portion of said leader.

2. The guide as described in claim 1, wherein said tongue includes a neck portion having a width smaller than the width of the aperture in the film, the width of said tongue being greater than the width of the aperture, the film pivoting about the neck of said tongue as the film is guided through the film processing equipment.

* * * * *